US006470914B1

(12) United States Patent
Hsiao

(10) Patent No.: US 6,470,914 B1
(45) Date of Patent: Oct. 29, 2002

(54) SWITCH DEVICE FOR GAS BURNER

(76) Inventor: Chi-Chen Hsiao, 531, Pei-Shin Street, Chia Yi City (TW)

( * ) Notice: Subject to any disclaimer, the term of this patent is extended or adjusted under 35 U.S.C. 154(b) by 216 days.

(21) Appl. No.: 09/712,455

(22) Filed: Nov. 15, 2000

(51) Int. Cl.[7] ..... F16K 11/18
(52) U.S. Cl. ..... 137/628; 137/636.4; 137/868; 431/280
(58) Field of Search ..... 137/628, 636.4, 137/868; 431/280

(56) References Cited

U.S. PATENT DOCUMENTS 5,799,698 A 9/1998 Lin

*Primary Examiner*—Gerald A. Michalsky
(74) *Attorney, Agent, or Firm*—Larson & Taylor, PLC

(57) ABSTRACT

A switch device for a gas burner includes a body engaged with a housing. The body defines an axial hole for rotatably receiving a driven shaft which has a first end secured in a rotation knob and a second end engaged with a barrel which can be rotated by the driven shaft. The barrel is screwed in the housing which is connected to a primary flame nozzle. When the rotation knob is pressed, the valve rod mounted in the barrel is forced by driven shaft to move linearly so as to open the valve hole directed toward the auxiliary flame. When the rotation knob is rotated, the passage directed toward the primary flame nozzle is opened.

5 Claims, 4 Drawing Sheets

SWITCH DEVICE FOR GAS BURNER

BACKGROUND OF THE INVENTION

1. Field of the Invention

The present invention relates to a switch device for a gas burner.

2. Description of the Related Prior Art

The closest prior art of which the applicant is aware is disclosed in U.S. Pat. No. 5,799,698 to Lin, filed on Jun. 5, 1996, entitled "SWITCH FOR GAS BURNER". However, the air-tight member is easily worn out due to friction during long term utilization so that it is necessary to detach the nozzle, the housing and the relating parts for replacing the air-tight member, thereby causing inconvenience in maintenance.

SUMMARY OF THE INVENTION

In accordance with one aspect of the present invention, there is provided a switch device for a gas burner comprising:

a body defining an axial hole;

a driven shaft rotatably mounted in the axial hole of the body and having a first end secured in a rotation knob and a second end provided with a first engaging portion;

a barrel defining a valve hole therein and having a first end provided with a second engaging portion engaged with the first engaging portion of the driven shaft and a second end provided with a valve block, the barrel having an outer wall formed with a first outer thread, a first air inlet hole and an annular air guide groove, the first air inlet hole located adjacent to the first outer thread and extended through the inner wall and the outer wall of the barrel, the air guide groove having an air guide hole extended through the inner wall and the outer wall of the barrel;

a valve rod slidably mounted in the valve hole of the barrel and provided with a valve body detachably enclosing the valve hole of the barrel;

a housing defining a chamber for receiving the barrel therein and having a first end secured to the body and a second end provided with an inner thread engaged with the first outer thread of the barrel, the inner thread of the housing defining a second inlet hole communicating with an air hole of an external connector, the housing provided with a side conduit engaged with an auxiliary flame connector; and a primary flame nozzle having a second outer thread engaged in the inner thread of the housing and defining a passage detachably rested by the valve block of the barrel.

Other objects, advantages, and novel features of the invention will become more apparent from the following detailed description when taken in conjunction with the accompanying drawings.

DETAILED DESCRIPTION OF THE INVENTION

Figure 1:
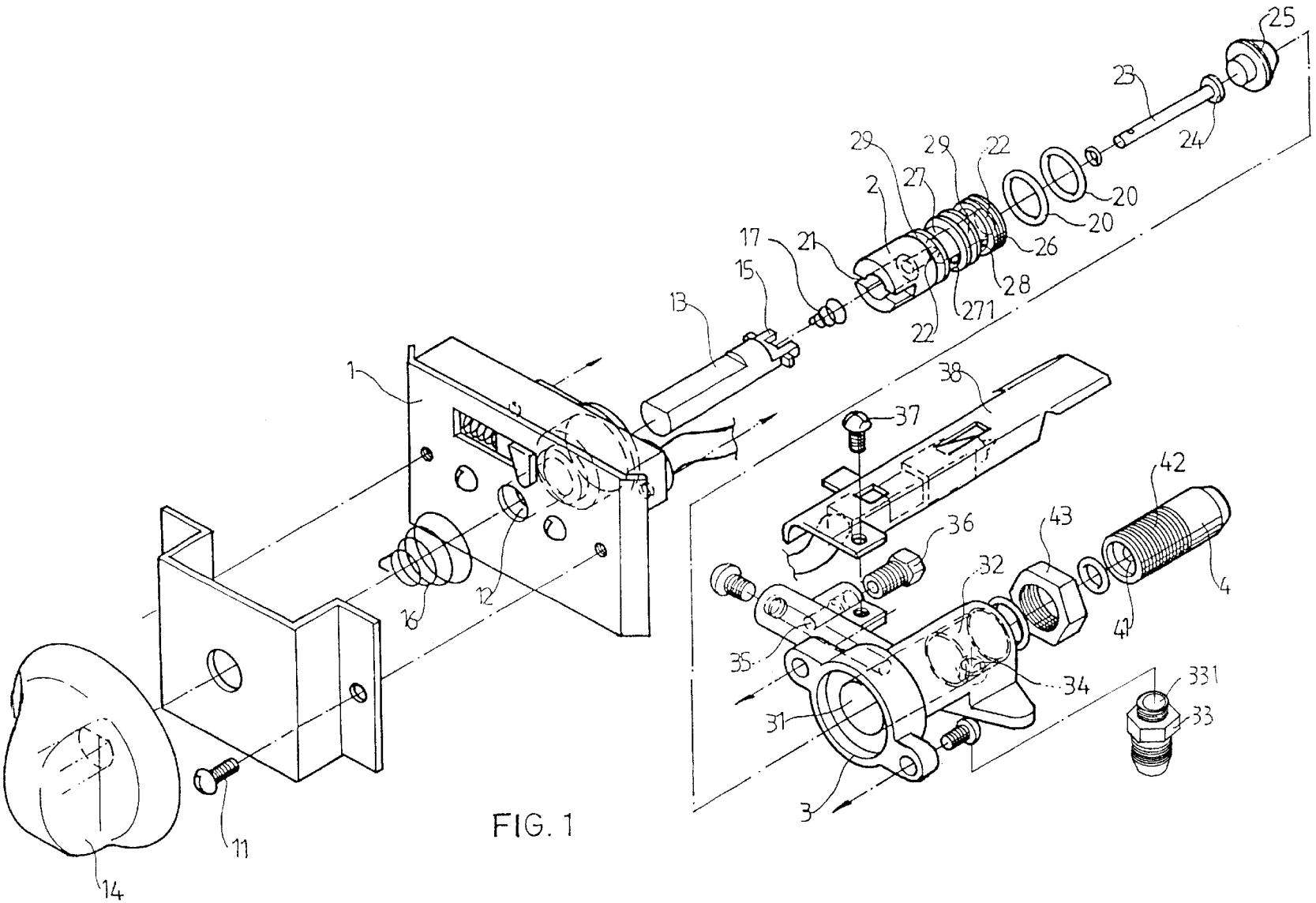
FIG. 1 is an exploded view of a switch device for a gas burner in accordance with the present invention.
Figure 3:
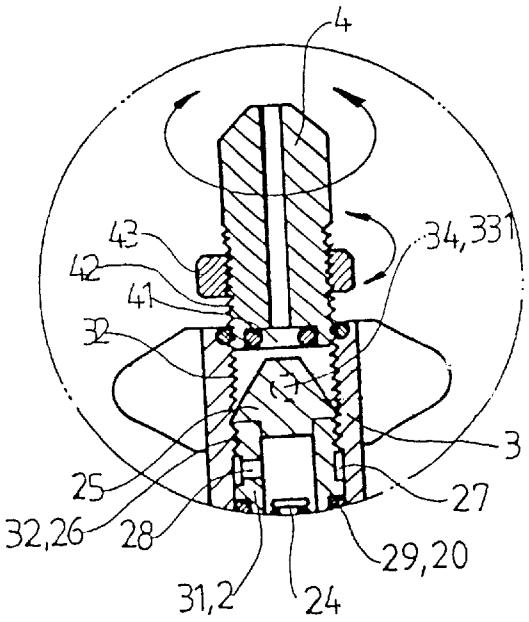
FIG. 3 is a partially enlarged view of the switch device for a gas burner as shown in FIG. 2.
Figure 2:
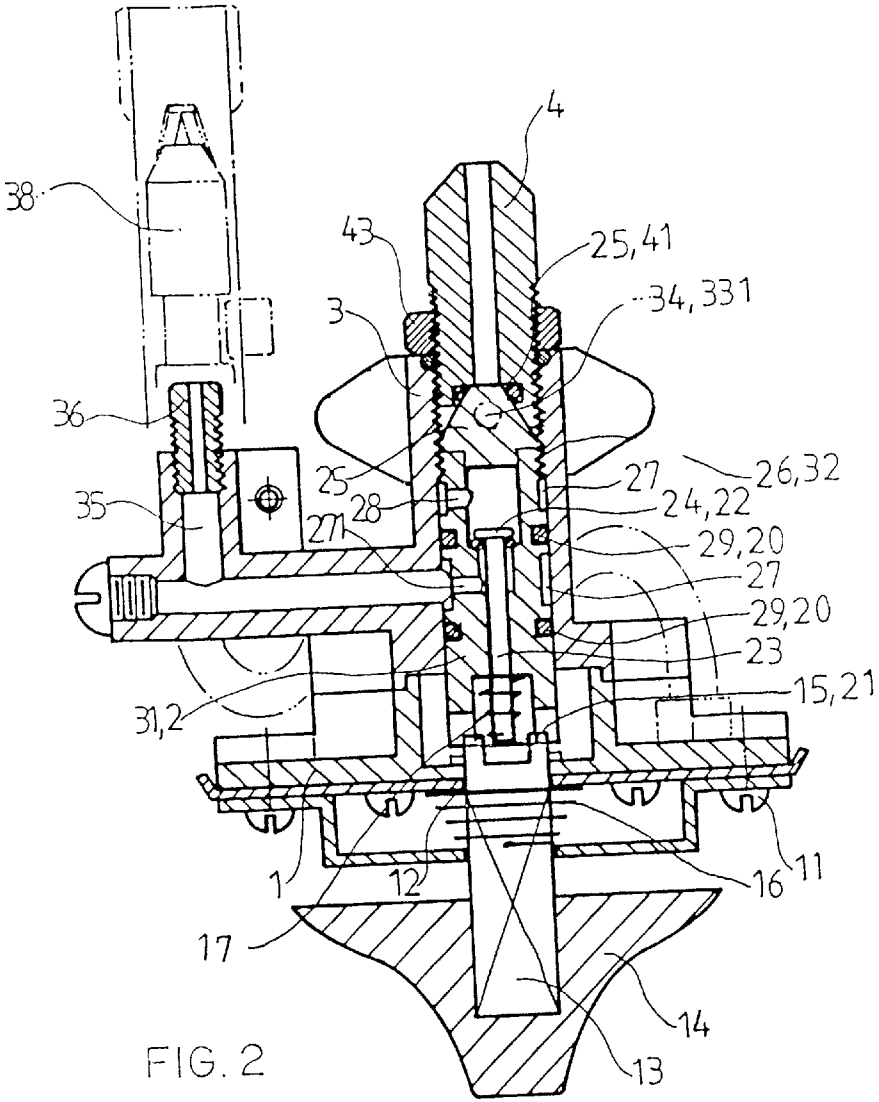
FIG. 2 is a top plan cross-sectional assembly view of the switch device for a gas burner as shown in FIG. 1.

Referring to the drawings and initially to FIGS. 1–3, a switch device for a gas burner in accordance with the present invention comprises a body 1, a barrel 2, a housing 3, and a primary flame nozzle 4.

The body 1 is engaged with the housing 3 by positioning members 11 such as bolts or the like. The body 1 defines an axial hole 12. A driven shaft 13 is rotatably mounted in the axial hole 12 of the body 1 and has a first end secured in a rotation knob 14 and a second end provided with a first engaging portion 15. An elastic member 16 has a first end secured on the driven shaft 13 and a second rested on the body 1 for providing a restoring action to the driven shaft 13 when a pressing force on the driven shaft 13 is removed so that the rotation knob 14 can be returned to its original position. On the other hand, when the rotation knob 14 is rotated, the driven shaft 13 can be rotated.

The barrel 2 defines a valve hole 22 therein and has a first end provided with a second engaging portion 21 engaged with the first engaging portion 15 of the driven shaft 13 and a second end provided with a valve block 25. The valve block 25 is formed with an oblique conical wall which can be moved to enclose or detach from the passage 41 of the primary flame nozzle 4, thereby controlling the closing or opening of the gas of the primary flame.

The first engaging portion 15 of the driven shaft 13 is formed with a U-shaped element, and the second engaging portion 21 of the barrel 2 is formed with a recess so that the barrel 2 is rotated by the driven shaft 13 while the barrel 2 is moved by an axial movement of the driven shaft 13.

The barrel 2 has an outer wall formed with a first outer thread 26, a first air inlet hole 28 and an annular air guide groove 27. The first air inlet hole 28 is located adjacent to the first outer thread 26 and extending through the inner wall and the outer wall of the barrel 2. The air guide groove 27 has an air guide hole 271 extended through the inner wall and the outer wall of the barrel 2, thereby forming the passageway of the gas of the auxiliary flame. The gas is introduced into the driven shaft 2 through the air inlet hole 28, then through the valve hole 22 of the barrel 2, the air guide hole 271, and the air guide groove 27, and then into the side conduit 35 of the housing 3. The air guide groove 27 has two sides each defining an annular groove 29 for receiving a rubber sealing ring 20.

A valve rod 23 is slidably mounted in the valve hole 22 of the barrel 2 and is provided with a valve body 24 detachably enclosing the valve hole 22 of the barrel 2. The valve rod 23 is urged by an elastic member 17 so that the valve body 24 is moved to enclose the valve hole 22 of the barrel 2, thereby closing the valve hole 22 of the barrel 2. On the other hand, the valve rod 23 is pushed by the driven shaft 13 so that the valve body 24 is moved to detach from the valve hole 22 of the barrel 2, thereby opening the valve hole 22 of the barrel 2 so that the gas can pass through the valve hole 22 of the barrel 2.

The housing 3 defines a chamber 31 for receiving the barrel 2 therein and has a first end secured to the body I and a second end provided with an inner thread 32 engaged with the first outer thread 26 of the barrel 2. The inner thread 32 of the housing 3 defines a second inlet hole 34 communicating with an air hole 331 of an external connector 33. The housing 3 is provided with a side conduit 35 engaged with an auxiliary flame connector 36 for conveying the gas to an auxiliary nozzle. An igniter 38 is secured to the housing 3 by a positioning member 37.

The primary flame nozzle 4 has a second outer thread 42 engaged in the inner thread 32 of the housing 3 and defines a passage 41 detachably rested by the valve block 25 of the barrel 2 for controlling the gas of the primary flame. A nut 43 is screwed on the second outer thread 42 of the primary flame nozzle 4 and is urged on an end face of the housing 3 for fixing the primary flame nozzle 4.

In operation, referring to FIGS. 2–7 with reference to FIG. 1, the primary flame nozzle 4 can be rotated from the position as shown in FIG. 3 to the position as shown in FIG. 2 so as to tightly fit the valve block 25. The screw 43 can then be rotated to tighten the primary flame nozzle 4, thereby achieving the purpose of adjustment.

Figure 5:
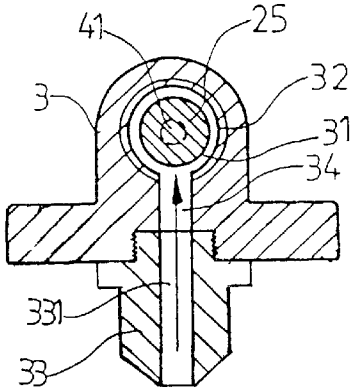
FIG. 5 is a side plan cross-sectional view of the switch device for a gas burner along the line 5—5 as shown in FIG. 4.
Figure 4:
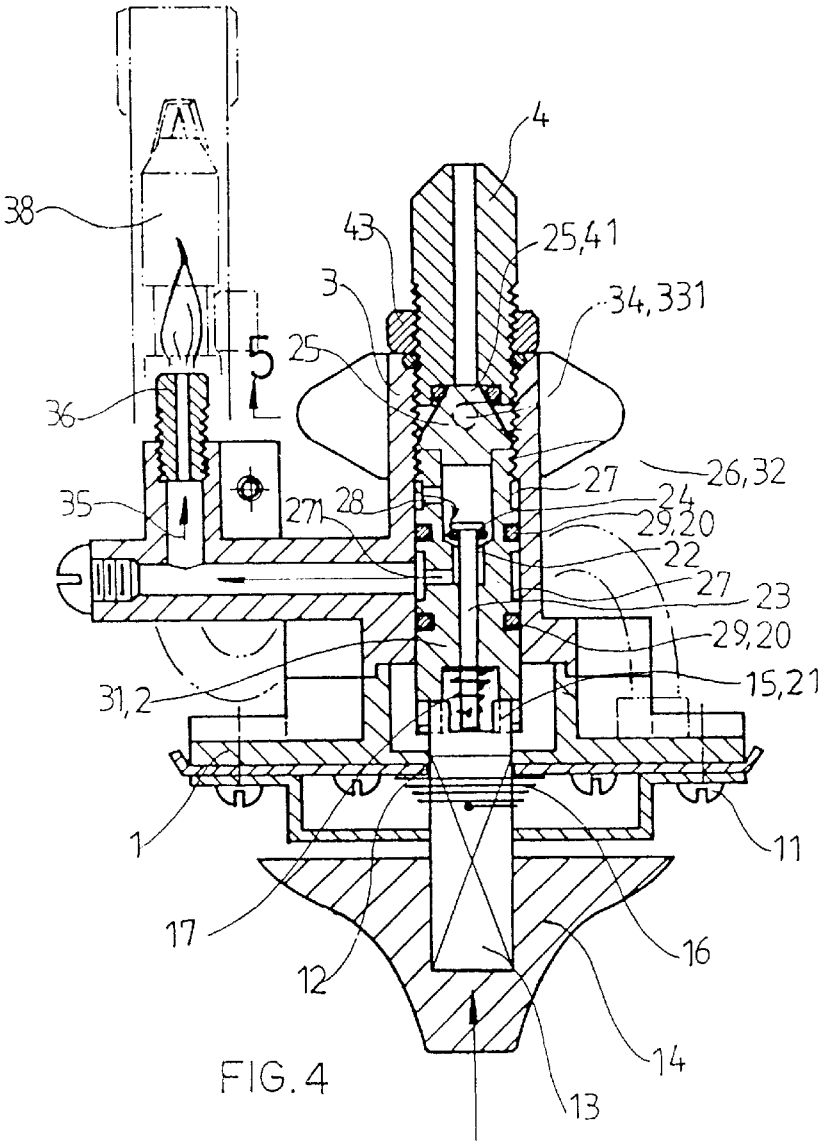
FIG. 4 is an operational view of the switch device for a gas burner as shown in FIG. 2.

As shown in FIGS. 4 and 5, the rotation knob 14 is pressed to move the driven shaft 13 which pushes the valve rod 23 to detach the valve body 24 from the valve hole 22 of the barrel 2 so that the gas enters the housing 3 through the air hole 331 of the external connector 33 , then through the air inlet hole 28 into the barrel 2, then through the valve hole 22, the air guide hole 271, the air guide groove 27, and the side conduit 35 to be ignited by the auxiliary flame nozzle, thereby forming the auxiliary flame.

Figure 7:
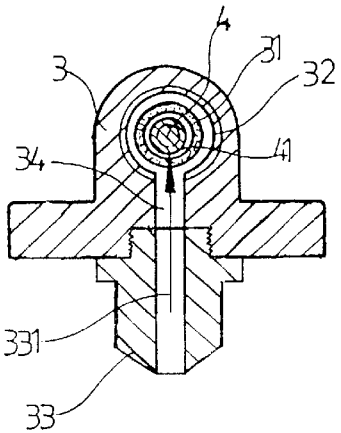
FIG. 7 is a side plan cross-sectional view of the switch device for a gas burner along the line 7—7 as shown in FIG. 6.
Figure 6:
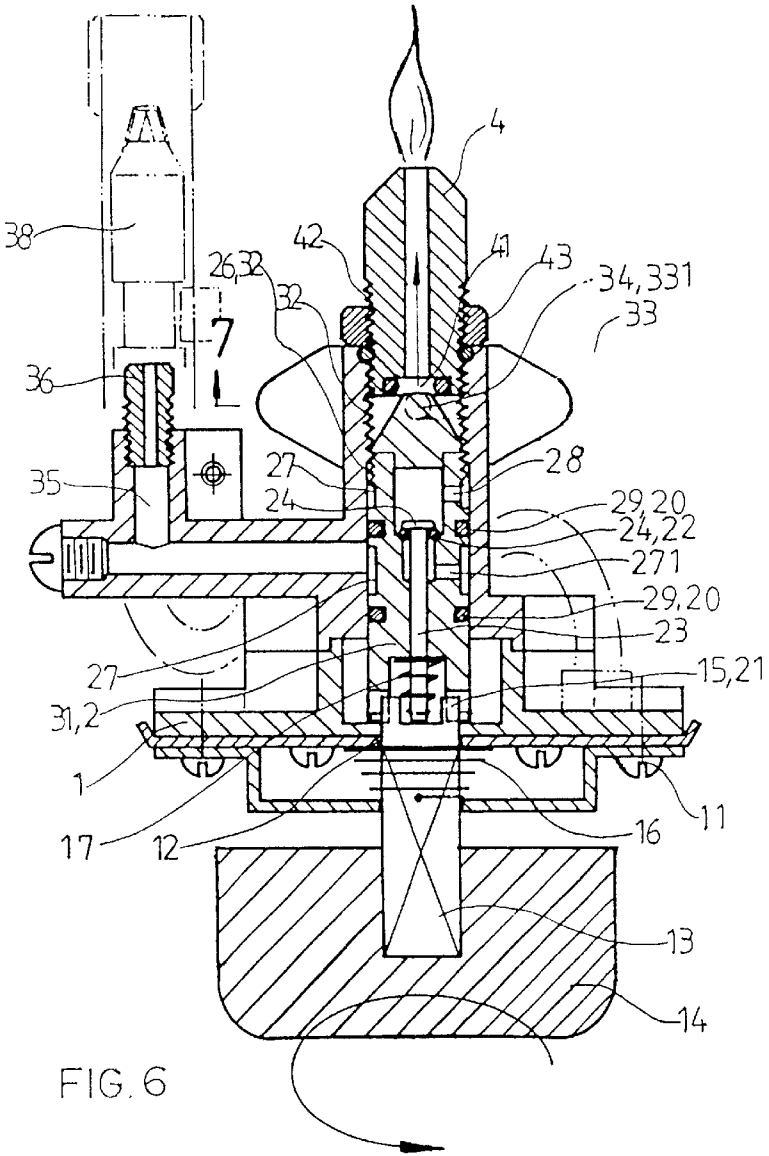
FIG. 6 is an operational view of the switch device for a gas burner as shown in FIG. 2.

As shown in FIGS. 6 and 7, when the pressure on the rotation knob 14 is removed, the rotation knob 14 is returned to its original position by the elastic member 16 while the valve rod 23 is returned to its original position by the elastic member 17, thereby closing the valve hole 22 by the valve body 24 so that the gas cannot enter the side conduit 3 5, thereby closing the auxiliary flame. Then, the rotation knob 14 is rotated to rotate the driven shaft 13 which rotates the barrel 2 which is moved linearly in the housing 3 to detach the valve block 25 from the passage 41 of the primary flame nozzle 4, thereby opening the passage 41 so that the gas is introduced through the connector 33, the air hole 331, and the passage 41 into the primary flame nozzle 4 to be burned by the auxiliary flame in the gas burner so that the primary flame can be ignited continuously.

Accordingly, the primary flame nozzle can be unscrewed easily, thereby facilitating the operator adjusting the primary flame nozzle.

Although the invention has been explained in relation to its preferred embodiment, it is to be understood that many other possible modifications and variations can be made without departing from the scope of the invention as hereinafter claimed.

What is claimed is:

1. A switch device for a gas burner comprising:

a body defining an axial hole;

a driven shaft rotatably mounted in the axial hole of the body and having a first end secured in a rotation knob and a second end provided with a first engaging portion;

a barrel defining a valve hole therein and having a first end provided with a second engaging portion engaged with the first engaging portion of the driven shaft and a second end provided with a valve block, the barrel having an outer wall formed with a first outer thread, a first air inlet hole and an annular air guide groove, the first air inlet hole located adjacent to the first outer thread and extended through the inner wall and the outer wall of the barrel, the air guide groove having an air guide hole extended through the inner wall and the outer wall of the barrel;

a valve rod slidably mounted in the valve hole of the barrel and provided with a valve body detachably enclosing the valve hole of the barrel;

a housing defining a chamber for receiving the barrel therein and having a first end secured to the body and a second end provided with an inner thread engaged with the first outer thread of the barrel, the inner thread of the housing defining a second inlet hole communicating with an air hole of an external connector, the housing provided with a side conduit engaged with an auxiliary flame connector; and a primary flame nozzle having a second outer thread engaged in the inner thread of the housing and defining a passage detachably rested by the valve block of the barrel.

2. The switch device for a gas burner in accordance with claim 1, further comprising an elastic member having a first end secured on the driven shaft and a second rested on the body for providing a restoring action to the driven shaft when a pressing force on the driven shaft is removed.

3. The switch device for a gas burner in accordance with claim 1, wherein the first engaging portion of the driven shaft is formed with a U-shaped element, and the second engaging portion of the barrel is formed with a recess so that the barrel is rotated by the driven shaft while the barrel is moved by an axial movement of the driven shaft.

4. The switch device for a gas burner in accordance with claim 1, wherein the air guide groove has two sides each defining an annular groove for receiving a rubber sealing ring.

5. The switch device for a gas burner in accordance with claim 1, further comprising a nut screwed on the second outer thread of the primary flame nozzle and urged on an end face of the housing for fixing the primary flame nozzle.

* * * * *